US005609931A

United States Patent [19]

Delavallade

[11] Patent Number: 5,609,931

[45] Date of Patent: Mar. 11, 1997

[54] PAPER MACHINE CLOTHING

[75] Inventor: Jean-Luc L. Delavallade, La Couronne, France

[73] Assignee: Scapa Group PLC, Lancashire, United Kingdom

[21] Appl. No.: 331,574

[22] PCT Filed: May 10, 1993

[86] PCT No.: PCT/GB93/00963

§ 371 Date: Feb. 22, 1995

§ 102(e) Date: Feb. 22, 1995

[87] PCT Pub. No.: WO93/23611

PCT Pub. Date: Nov. 25, 1993

[30] Foreign Application Priority Data

May 9, 1992 [GB] United Kingdom ..... 9210066

[51] Int. Cl.[6] ..... B29D 22/00

[52] U.S. Cl. ..... 428/36.1; 139/383 A; 428/192; 428/193; 442/203

[58] Field of Search ..... 428/36.1, 222, 428/223, 225, 229, 234, 257, 192, 193; 139/383 A

[56] References Cited

U.S. PATENT DOCUMENTS

| | | |
|---|---|---|
| 4,636,426 | 1/1987 | Fleischer . |
| 4,842,212 | 6/1989 | Loiselle et al. . |
| 4,846,231 | 7/1989 | Penven . |
| 4,991,630 | 2/1991 | Penven . |

FOREIGN PATENT DOCUMENTS

| | | |
|---|---|---|
| 0341043 | 5/1989 | European Pat. Off. . |
| 2202870 | 3/1988 | United Kingdom . |
| WO91/04374 | 9/1990 | WIPO . |

*Primary Examiner*—James J. Bell
*Attorney, Agent, or Firm*—Keck, Mahin & Cate

[57] ABSTRACT

A method of weaving a papermakers fabric having weft loops in which the loop forming weft yarn is woven as two picks in a common shed in each respective fabric layer as it exists in the loom. The weft yarn is wrapped about a core yarn at one edge of the fabric as it exists in the loom between successive weft insertions in said common shed.

5 Claims, 3 Drawing Sheets

PAPER MACHINE CLOTHING

The invention concerns paper machine and like clothing, and has more particular reference to an endless woven fabric having weft loops.

The object of the invention is to provide an endless woven papermakers fabric, and particularly a pulp fabric, having weft loops which are essentially orthogonal with respect to the plane of the fabric.

According to the present invention there is proposed a method of weaving a papermakers fabric having weft loops wherein the loop forming weft yarn is woven as two picks in a common shed in each respective fabric layer as it exists in the loom, said yarn being wrapped about a core yarn at one edge of the fabric as it exists in the loom between successive weft insertions in said common shed, characterised in that the fabric is of plain weave construction and the method includes the further step of shifting the weave pattern longitudinally of the fabric by one pick at a position remote from said one edge prior to inserting two picks to form the next loop at said one edge.

According to a further feature of the invention the weave pattern shift is effected at the other edge of the fabric as it exists in the loom.

According to a still further feature, the method includes the further step of resin treating the loops to maintain a substantially orthogonal relationship between the loops and the plane of the fabric.

The invention also includes an endless woven papermakers fabric having weft loops, wherein said loops are substantially orthogonal with respect to the plane of the fabric and each loop is formed by two successive picks woven in a common shed in that region of the fabric adjacent each respective loop, characterised in that the fabric is formed as a tube with linked ends, the fabric being a plain weave and the weave pattern being shifted longitudinally of the fabric by one pick at a position remote from the linked ends of the fabric.

According to a still further preferred feature, the weave pattern is shifted longitudinally of the fabric by one pick at a position approximately midway between the linked ends of the fabric.

The invention will now be described further, by way of example only, with reference to the accompanying diagrammatic drawings illustrating one embodiment thereof and in which.

Figure 1:
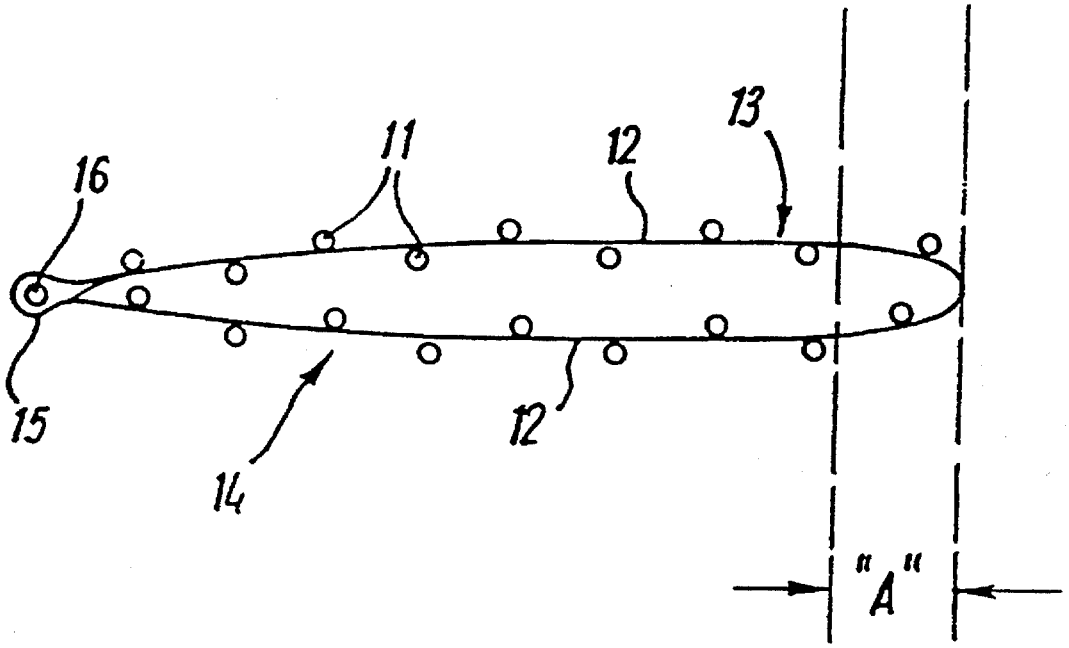
FIG. 1 is an elevation of an endless fabric as it exists on the loom and illustrates the two-layer nature thereof during manufacture.

Referring now to FIG. 1 of the drawings, an endless fabric comprises warp and weft yarns 11, 12 woven together to give upper and lower layers 13, 14 in the loom as is conventional, weft loops 15 being formed by weaving the weft yarns about a monofilament core yarn 16 provided at one side of the loom.

On completion of the weaving operation the core yarn 16 is removed, and the tubular woven fabric is opened out to give a flat structure having loops 15 at the respective ends thereof, such loops being formed from weft yarns and the weft yarns extending in the intended machine direction of the fabric.

On application to a papermakers machine the loops 15 at the respective fabric ends are interdigitated to define a tunnel to receive a jointing wire (not shown).

In the prior method aforesaid, the warp shedding is changed between the successive picks introduced in a given fabric layer, and thus the weft yarn as it exists about the core yarn 16 to form the loop 15 follows a helical path, such helical configuration being retained by the loop 15 on removal of the core yarn 16.

On interdigitation of the loops and insertion of the jointing wire the permeability of the fabric in the region of the join is different from the body of the fabric, but a more significant disadvantage lies in the extent to which the loops abrade in use, the rate of wear being adversely affected by the inclined disposition of the loops relative to the direction of movement of the fabric in use thereof.

Figure 2:
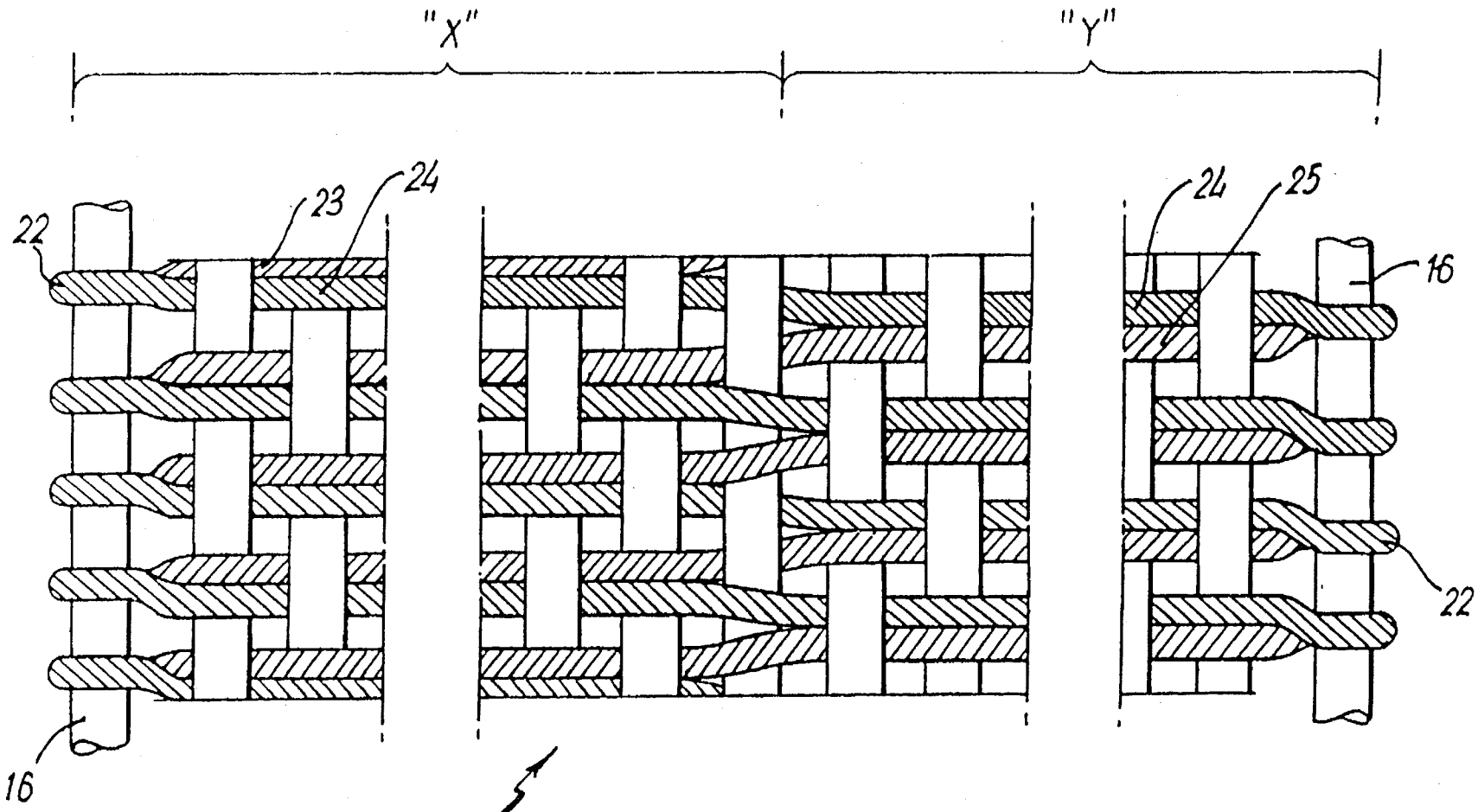
FIG. 2 is a plan view of the endless fabric of the invention produced in a similar manner to that illustrated in FIG. 1 and opened up to show, inter alia, the weave pattern in the region corresponding to region A of FIG. 1.
Figure 3:
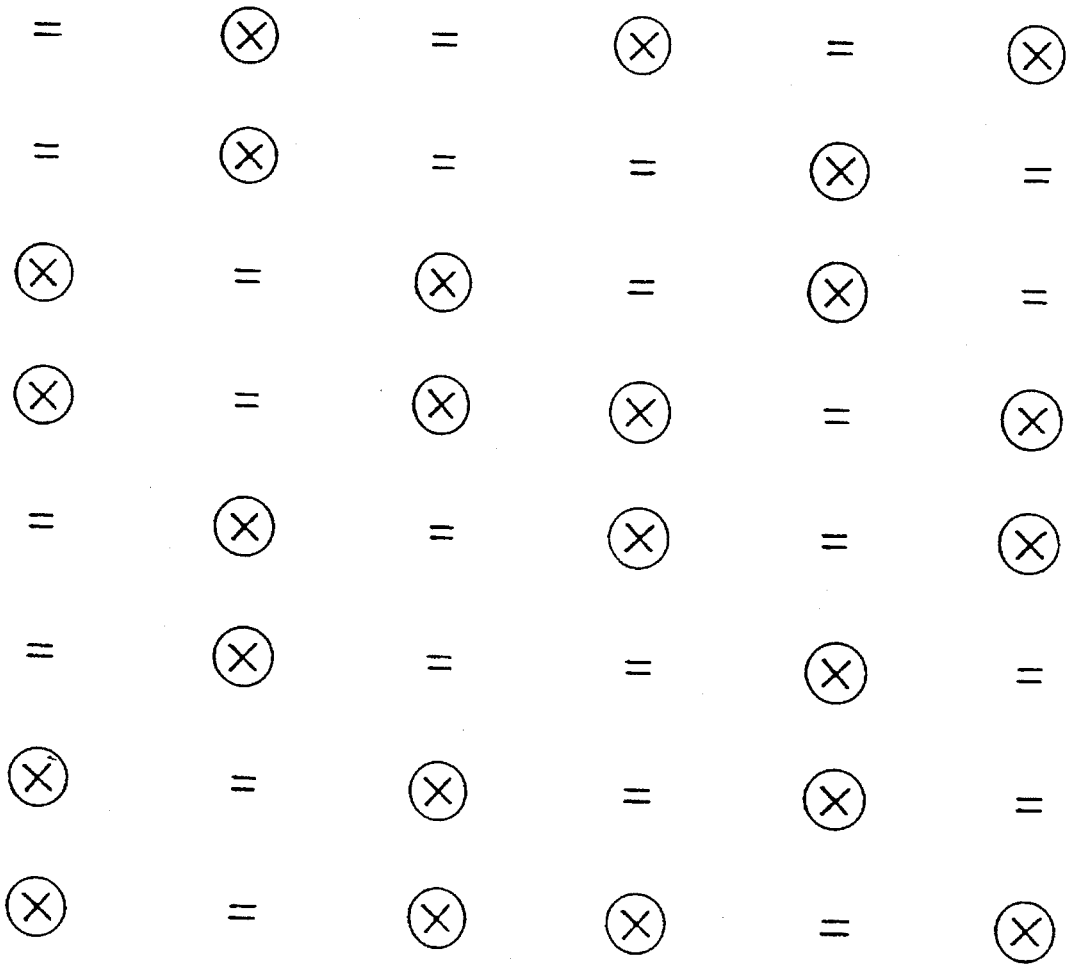
FIG. 3 is a weaving diagram showing the shed changes appropriate to the weft shift shown in FIG. 2.

In the weave structure of the present invention as illustrated in FIGS. 2 and 3 the weaving process is such as to provide loops which are essentially orthogonal to the plane of the fabric, such disposition having a lesser adverse effect on drainage in the region of the loops and leading to a reduced rate of wear of the loops.

Thus, referring now to FIGS. 2 and 3 of the drawings, in providing an endless papermakers fabric 21 of plain weave construction and having weft loops 22, each loop 22 is formed by and between successive picks introduced into a common shed, the weft yarn being wrapped about a monofilament core yarn between successive pick insertions. Loops 22 are formed at one edge only of the double layer fabric as it exists in the loom, and the shed is changed to shift the weave pattern by one pick in the longitudinal direction of the fabric in the loom in moving from weaving the upper fabric layer "X" to weaving the lower fabric layer "Y", and vice versa.

By proceeding in this way, the second pick 24 of a loop forming pair 23, 24 in one fabric layer becomes the first pick 24 of the loop forming pair 24, 25 in the other fabric layer, the shift being repeated for weaving the alternate layers.

The shift is illustrated in FIG. 2 of the drawings. Whilst it is convenient to effect the pattern shift at that edge of the fabric, in the loom, remote from the loops, such shift can be affected at any other position intermediate the edges of the double layer fabric in the loom and may indeed be programmed to occur at different positions across the fabric as construction thereof proceeds.

In order to maintain the orthogonal disposition of the loops relative to the fabric such loops will ordinarily be subjected to a resin or other treatment, and as is conventional practice, as too may the fabric.

In a typical pulp felt, the machine direction yarns, which yarns are the weft yarns in the loom, comprise a composite yarn made up of 230 Tex staple polyamide fibre yarn wrapped with a 188 Tex multifilament polyamide, the composite yarn being cabled threefold to give a total yarn count of 1500 Tex. The cross-machine direction yarns being the warp yarns in the loom, again comprise staple polyamide fibre yarn of 230 Tex wrapped with a multifilament polyamide of 188 Tex, the wrapped single yarn being doubled and four doubled yarns being twisted together to give a total yarn count of 4100 Tex.

The loom fabric has 20 warp yarns and 18×2 weft yarns per unit length, the corresponding yarn densities of the finished fabric being 20 and 23×2.

The region of the weft loops is subjected to a treatment based on resorcinol formaldehyde whilst the body of the fabric is treated with a melamine resin.

Whilst the structure as hereinbefore described may be used as a pulp felt per se, if desired the pulp face thereof may be provided with a batt layer, typically a layer of 22 Tex fibre of 100 g.s.m, the batt layer being needled to the woven structure.

The invention is not limited to the detail of the embodiment hereinbefore set forth, and modifications and variations will readily present themselves to one skilled in the art.

I claim:

1. A method of weaving a papermakers fabric having weft loops wherein the loop forming weft yarn is woven as two picks in a common shed in each respective fabric layer as it exists in the loom, said yarn being wrapped about a core yarn at one edge of the fabric as it exists in the loom between successive weft insertions in said common shed, characterised in that the fabric is of plain weave construction and the method includes the further step of shifting the weave pattern longitudinally of the fabric by one pick at a position remote from said one edge prior to inserting two picks to form the next loop at said one edge.

2. A method as claimed in claim 1, characterised in that the weave pattern shift is effected at the other edge of the fabric as it exists in the loom.

3. A method as claimed in claim 1 or claim 2, characterised in that the method includes the further step of resin treating the loops to maintain a substantially orthogonal relationship between the loops and the plane of the fabric.

4. An endless woven papermakers fabric having weft loops, wherein said loops are substantially orthoganol with respect to the plane of the fabric and each loop is formed by two successive picks woven in a common shed in that region of the fabric adjacent each respective loop, characterised in that the fabric is formed as a tube with linked ends the fabric being a plain weave and the weave pattern being shifted longitudinally of the fabric by one pick at a position remote from the linked ends of the fabric.

5. A papermakers fabric as claimed in claim 4, characterised in that the weave pattern is shifted longitudinally of the fabric by one pick at a position approximately midway between the linked ends of the fabric.

* * * * *